US005266148A

United States Patent [19]

Keech et al.

[11] Patent Number: 5,266,148

[45] Date of Patent: Nov. 30, 1993

[54] TRIPLE WALL FOLD CONSTRUCTION AND FORMING PROCESS AND MECHANISM

[75] Inventors: Roderick G. Keech, Louisville, Ky.; James F. Smith, Wassaic; John W. Flynn, Dover Plains, both of N.Y.

[73] Assignee: Weyerhaeuser Company, Tacoma, Wash.

[21] Appl. No.: 476,525

[22] Filed: Feb. 7, 1990

[51] Int. Cl.[5] ..... B31F 1/00

[52] U.S. Cl. ..... 156/470; 156/510; 156/250; 156/257; 156/259; 156/268; 156/269; 156/271; 83/105; 83/425; 83/875

[58] Field of Search ..... 156/259, 257, 268, 269, 156/271, 250, 470, 510; 83/875, 102.5, 105, 425

[56] References Cited

U.S. PATENT DOCUMENTS

| | | | |
|---|---|---|---|
| 2,759,523 | 8/1956 | Goldstein et al. . | |
| 3,122,976 | 3/1964 | Anderson . | |
| 3,290,205 | 12/1966 | Goldstein et al. . | |
| 3,616,077 | 10/1971 | Jessee | 156/259 |
| 4,091,697 | 5/1978 | Cailey | 83/875 |
| 4,342,349 | 8/1982 | Lipman | 83/875 |
| 4,401,004 | 8/1983 | Glans et al. | 83/875 |
| 4,539,064 | 9/1985 | Andruchiw et al. | 156/535 |
| 4,656,910 | 4/1987 | Peterson | 83/875 |

FOREIGN PATENT DOCUMENTS 52-52961 4/1977 Japan .

OTHER PUBLICATIONS

Tri-Wall Data Sheet entitled "Tri-Wall VLC (Variable Layer Container)".

Tri-Wall Data Sheet entitled "Tri-Wall Notchfold".

Tri-Wall Data Sheet for Tri-Wall Pak containers for extra long and inter-plant product applications.

*Primary Examiner*—Patrick J. Ryan
*Assistant Examiner*—Merrick Dixon
*Attorney, Agent, or Firm*—Notaro & Michalos

[57] ABSTRACT

An improved triple wall corrugated paper board fold construction is formed by joining a single face web with a nonadhered band of the medium to a contiguous liner of another one of the single face webs, slitting and removing a portion of the nonadhered band along a narrow bending area, and removing the slit strip to leave a bending groove formed with one or more score lines in the material underlying the groove, as the board continuously moves along a path of travel.

15 Claims, 5 Drawing Sheets

TRIPLE WALL FOLD CONSTRUCTION AND FORMING PROCESS AND MECHANISM

BACKGROUND OF THE INVENTION

The invention relates generally to triple wall corrugated paper board and, more particularly, to a new and improved flap fold construction for such material, a process for forming the fold construction and devices used in the process.

Triple wall corrugated paper board is a lamination of four paper liners and three corrugated paper mediums, each of the mediums being interposed between two liners in each instance. The liners and mediums are intimately and rigidly secured to each other by adhesive applied to the ridges of the corrugations of the mediums.

The corrugations of the mediums are parallel to each other throughout the board. Three types of corrugations are typically used in triple wall construction, namely, types A, B and C. "A" flute is approximately 3/16 of an inch (4.7625 mm) high with 33.8 flutes of corrugations per linear foot (1.181 flutes of the corrugations per linear cm). "B" flute is approximately ⅛ of an inch (3.175 mm) high with 50 flutes of the corrugations per linear foot (1.6406 flutes of the corrugations per linear cm). "C" flute is about 5/32 of an inch (3.9688 mm) high with 42 flutes of the corrugations per linear foot (1.378 flutes of the corrugations per linear cm).

Various grades of paper board of different weight and characteristics are used for forming the corrugated medium and liner. Consequently, triple wall corrugated paper board is relatively thick and rigid. For example, triple wall corrugated paper board formed of A-A-A fluting is about ⅝ of an inch (15.875 mm) thick and, if made of A-A-C fluting, is about 9/16 of an inch (14.288 mm) thick.

Triple wall corrugated paper board has superb rigidity and strength, which compares favorably to wood as a packaging material. Yet, it is lightweight, foldable and has cushioning qualities that cannot be approached by wood. The strength, rigidity and cushioning properties of triple wall corrugated paper board makes it particularly useful and versatile in packaging a variety of articles of large volumes that may be heavy or fragile, or both. For example, cartons made of triple wall corrugated paper board are used for containing heavy materials such as industrial machinery or large appliances, smaller heavier materials such as machine parts, materials that are shiftable in transit such as bulk flowables, bulky agricultural products such as large loads of melons, and fragile items that may not necessarily be heavy as well, such as electronic equipment.

Triple wall corrugated paper board has been successfully manufactured for many years in accordance with the general techniques described in U.S. Pat. Nos. 2,759,523 and 3,290,205.

Foldable cartons composed of triple wall corrugated paper board are ordinarily made from flat blanks that are scored and slotted to define the side panels and end flaps of the cartons. When such a carton is assembled, the panels and end flaps are folded along the score lines. Because of the rigidity and thickness of the triple wall corrugated paper board, resistance is often experienced in folding the flaps, especially in the case of cartons having narrow flaps. One expedient employed to reduce this difficulty has been the formation of a broad score line to crush the flap in the bending zone and, thereby, to minimize bending resistance. This solution is not entirely satisfactory, however, because the bending line is not clearly defined and the flap may tend to bend unevenly and unpredictably.

Another solution proposed for minimizing the resistance to bending of the flap, described in U.S. Pat. No. 3,122,976, is the provision of a blank with a crush-relieved zone contiguous to the score lines for the flaps. Nevertheless, when such a bend is made in triple wall corrugated paper board, a substantial amount of paper is compressed into the corner of the bend. This may cause the flap adjacent to the bend to bow slightly and prevent the flap from resting on a plane surface. The resulting carton, therefore, may rock. In addition, large forces may be required to bend the flap.

One solution, particularly for extra-long folds such as use needed for folding the panels in long-tubular containers, has been to cut a V-shaped groove into the board only through two of the corrugated mediums and two liners leaving the third "wall" composed of a corrugated medium, two liners undamaged so that sufficient material remains to preserve the integrity of the board. On the other hand, sufficient material is removed by the cutter so that the remaining paper, when compressed into the score does not cause the flap to bow and the flap remains flat. The force required to bend the board is considerately reduced. Great care must be exercised, however, in order to precisely remove the adhesively-bonded liners and fluting without damage to the remaining material.

An alternative solution has been the formation of triple wall corrugated paper board sheet having single wall flaps. In this construction, two single face webs of the triple wall lamination have a shorter width than the third single face web and fourth liner. The small band along the edge of the shorter intermediate single face web is not glued to the underlying longer liner of the single face web bonded to the fourth liner. The edge is scored, slit and trimmed. A single wall flap is thereby formed. The single wall flap is easily foldable. A number of difficulties, however, have been experienced. In the formation process, in the heating section of the corrugated paper board machine, it is difficult to secure proper adhesion along the single wall flap due to the differences in the thickness relative to the remainder of the board. In addition, the resulting board is difficult to fabricate into boxes, the board stacks unevenly and is more difficult to print. The single wall flaps are not as sturdy as triple wall flaps.

Thus, a need exists for a flap fold construction for triple wall corrugated paper board which does not have the disadvantages of various prior constructions but is simple to manufacture and stable in construction.

SUMMARY OF THE INVENTION

The invention relates to improved forming devices and processes and a resulting improved fold construction in a triple wall corrugated paper board having three corrugated mediums and four flat liners, the corrugated mediums each having corrugations parallel to each other throughout the board, each of the corrugated mediums being adhesively bonded at one side thereof to a different one of the liners to form a single face web with the mediums thereof having ridges at the side of said sheet opposite the liner, the three single face webs and fourth liner being juxtaposed with the ridges of a first two of the single face webs contiguous with the liner of another of the single face webs and the ridges of the medium of the other one of the single face webs contiguous with the fourth liner.

In the process of forming triple wall corrugated paper board, according to the invention, a band of adhesive is omitted from the ridges of one of the corrugated medium, preferably, along a narrow bend area, on the ridges of the corrugated medium of the middle single face web. In such case, the board is slit through the first two single face webs overlying the remaining single face web (bonded to the fourth liner) along the nonadhered band to form a slit strip and the slit strip is removed from the bond by a plough device. Alternatively, the adhesive may be omitted from the ridges of the single face web most remote from the single face web that is bonded to the fourth liner. In such case, only the first-mentioned single face web is slit along the bend area.

The improved fold construction is formed in a corrugated paper board machine which moves the single face webs and the fourth liner through a path of travel with the corrugations transverse to the path of travel. In an improvement, according to one aspect of the invention, means are provided for preventing the application of adhesive to the ridges of one of the first two single face webs contiguous with the liner of the third single face web (which is to be bonded to the fourth liner) along the narrow bend area over length of the board in the direction of the travel. Slitting means are provided for cutting a pair of slits through the liner and corrugated medium from which the adhesive has been omitted within the bend area. A pair of rotatable score wheels are mounted in the path of travel in cooperative superimposed relation and are operative to form a score line along the bend area in the portion of the board that has not been slit. A plough device, also aligned with the path of travel, engages the slit strip, lifts the strip and diverts the strip away from the path of travel. The plough device preferably is composed of a blade for insertion between the ridges of the single face sheet of the non-adhered slit strip and the contiguous liner of the adjacent single face sheet. The blade engages the ridges and the movement of the board along the path of travel causes the slit strip to move along the blade to the attached shank and into contact with a diverter plate. The slit strip is thus diverted away from the path of travel.

One aspect of the improved fold construction, formed in accordance with the invention, is a groove in the narrow bend area extending through at least one of the said first two of the single face webs. A bending score underlies the groove. In a preferred embodiment, the groove extends through both of the first two single face webs and the underlying score comprises scores that are formed beneath the bottom of the groove in the third single face web and in the fourth liner.

BRIEF DESCRIPTION OF THE DRAWING

In the accompanying drawings, forming a part of this specification, and in which reference numerals shown in the drawings designate like or corresponding parts throughout the same.

DETAILED DESCRIPTION

Figure 1:
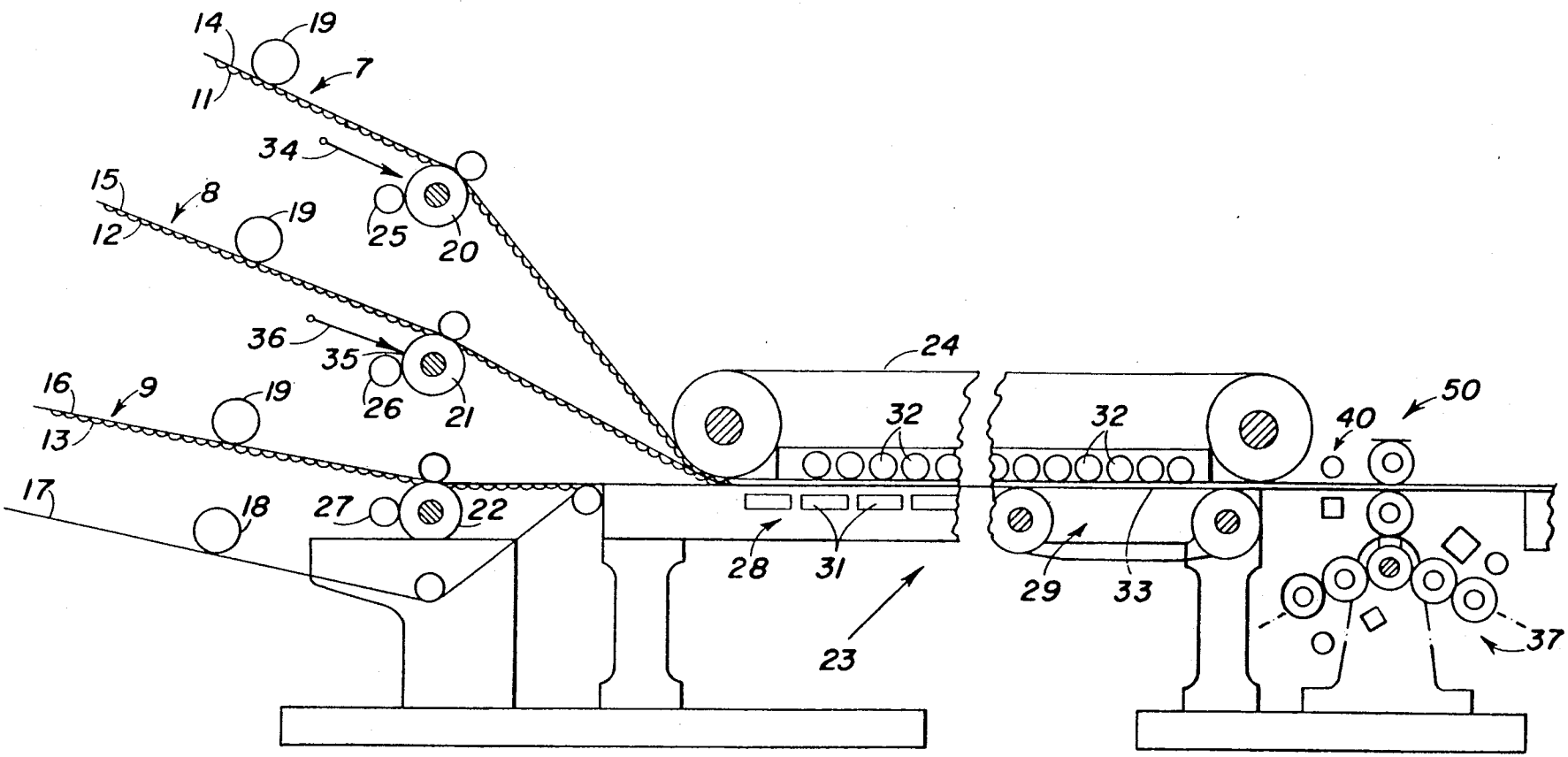
FIG. 1 is a diagrammatic longitudinal view of the combining, scoring and trimming end of a corrugated paper board machine in which the novel features of the inventive process have been incorporated to enable the production of triple wall corrugated paper board by the method of the invention.

FIG. 1 illustrates the combining end of a corrugated paper board machine for producing triple wall corrugated paper board that is, a composite board comprising three corrugated paper mediums interposed between four spaced flat paper liners.

It will be understood that the corrugations of corrugated medium of paper are corrugated transversely of the path of travel through the machine and adhesively applied to the liner sheets.

Three mediums 11, 12 and 13 are corrugated and the ridges of the corrugations are adhesively secured to liner sheets 14, 15, 16 in a well-known manner, in manufacturing steps not shown in FIG. 1, to form three composite webs known as single face webs 7, 8, 9. The three single face webs 7, 8, 9 are passed over preheater drums 19 in order to prepare the free ridges of the corrugations, opposite the respective liner of the sheets, for receiving an adhesive.

An outer or fourth liner 17, which comprises a sheet of liner board, is similarly passed around a preheater drum 18.

The three preheated single face webs 7, 8, 9 are brought to upper, intermediate and lower gluing rolls 20, 21, 22. Adhesive is controlled on the gluing rolls 20, 21, 22 by ductor rolls 25, 26, 27. The gluing rolls 20, 21, 22, in turn, apply the adhesive to the ridges of the corrugations which extend transversely of the direction of the path of travel of the three single face webs and fourth liner which are juxtaposed and brought together beneath a first endless belt 24 in the heating and drying section 28 of a so-called double facer or double backer 23. In the double backer 23, the adhesive bearing ridges of the still exposed corrugations 11, 12 of the first two single face webs 7, 8 are contacted with liners 15, 16 of the contiguous underlying single face webs 8, 9, respectively, while the adhesive bearing ridges of corrugations 13 of the third single face web 9 are contacted with the fourth liner 17.

The double backer 23 is a very long two part machine having heating and drying section 28 composed of a series of flat, internally heated steam plates 31 over which the above-described sandwich of single face webs and fourth liner are passed. The upper face of the lower run of the belt 24 is weighed down by weight rollers 32 to press the sandwich into good heat transfer relationship with the heated steam plates 31. The sandwich is then passed to the second part of the double backer 23 known as cooling or pulling section 29. In the cooling section, the heated stream plates 31 are replaced by a second endless belt 33 which helps to pull the board through the entire machine. Board cooling begins at this point and when the board leaves the cooling section 29, it is a completed, permanently bonded, material.

Figure 2:
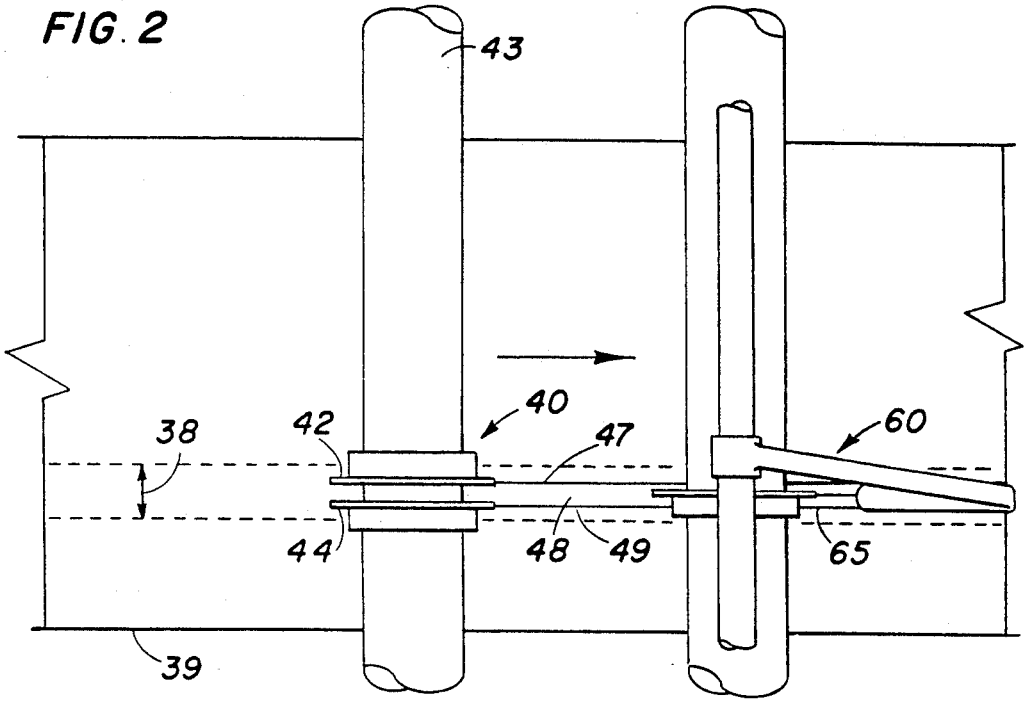
FIG. 2 is a plan view of a portion of FIG. 1.

In accordance with the invention, a retractable wiper assembly 34 or 36 is provided adjacent to the upper or intermediate gluing rolls 20 or 21 respectively. The wiper assemblies 34 or 36 includes a wiper 35 which is engaged against the adjacent rotatable gluing roll 20 or 21 to wipe a circumferential band of adhesive off of the gluing roll so that, transverse to the direction of travel, a predetermined width of the ridges of the corrugated medium does not receive the adhesive and is not adhered to the underlying sheet in a narrow bending area 38. As shown in FIG. 2, the nonadhesive band is formed over a transverse width remote from the longitudinal edge 39. The bend area 38 has a broader width than that needed for the scores which will form the bending line.

As the endless sheet of corrugated paper board leaves the double backer 23, it enters a portion of the combiner known as the triplex or slitter 37. The triplex 37 typically has two functions. First, it places flap scores in the board at the proper position. Second, it trims the edge of the board.

Figure 3:
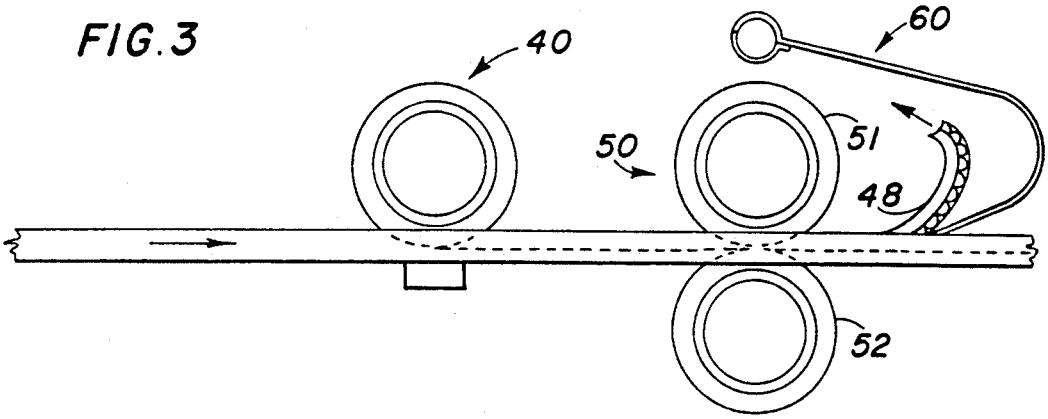
FIG. 3 is a side view of FIG. 2.

A slitter mechanism 40 is arranged in the triplex aligned with the bend area 38 downstream of the cooling section 29. The slitter mechanism 40, as shown in FIGS. 2 and 3, comprises a rotatable shaft 43 which carries a pair of blades 42, 44. The blades 42, 44 are bevelled on one side only, the sides opposing each other. The blades form a pair parallel slits 47, 49 perpendicular to the corrugations through the first single face web 7 or first two single face webs 7, 8 to form a removable slit strip 48.

Figure 6:
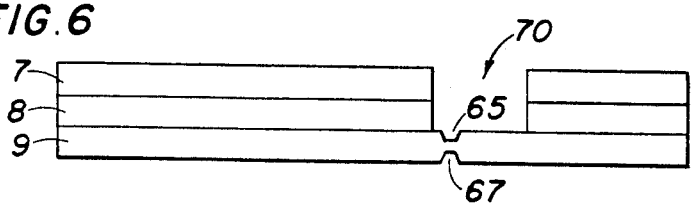
FIG. 6 is an end view of FIG. 5.

The board is next passed to the scoring mechanism 50 which comprises superimposed upper and lower score wheels 51, 52 that place score lines 65, 67 (see FIG. 6) into the portion of the underlying board intermediate the slits 47, 49. The upper score wheel 51 has a profile designed to indent the board to form score line 65 in the single face sheet 9 at a point at which the bend is to be made, intermediate the slits 47, 49. The lower score wheel 52 is profiled to form an score line 67 into the liner 17 and medium 13.

Further downstream of the scoring mechanism 50, a plough 60 is provided for lifting and diverting the slit strip 48 of the board that overlies the bend area.

Figure 4:
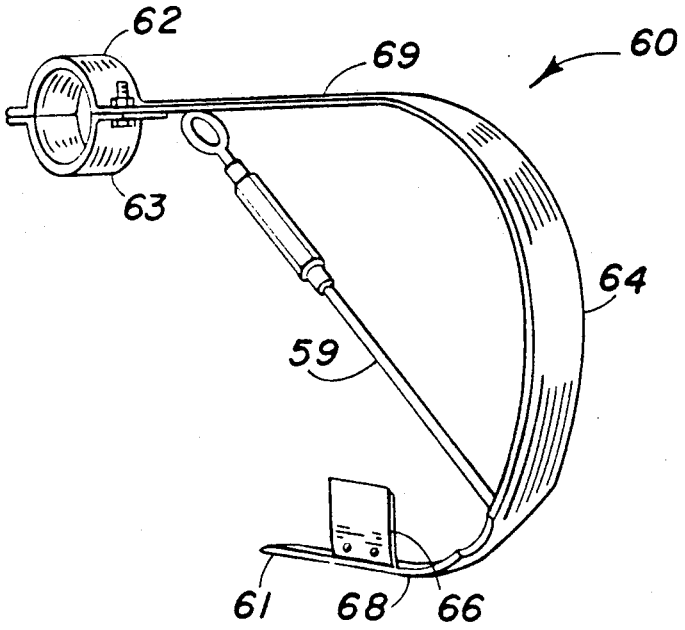
FIG. 4 is a perspective view of the plough mechanism of the inventive device.
Figure 5:
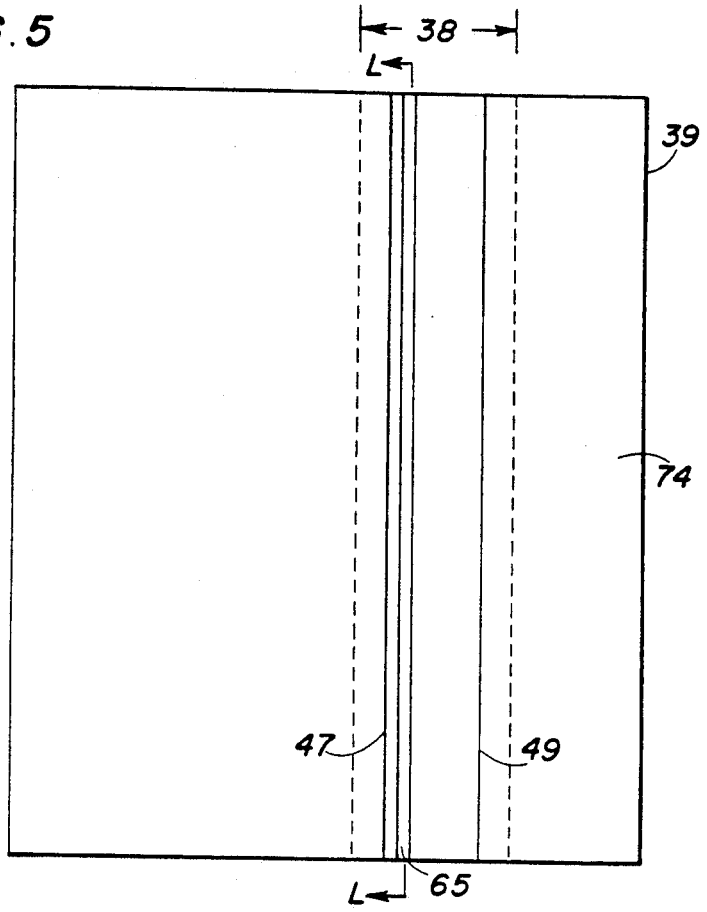
FIG. 5 is a plan view of a composite corrugated sheet which has been slit and scored.
Figure 7:
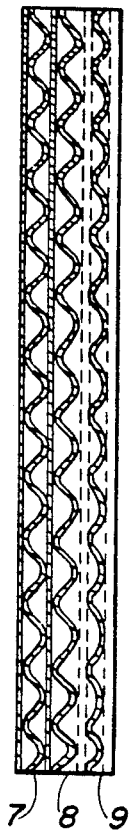
FIG. 7 is a sectional view taken along view line 7—7 of FIG. 5.

The plough 60, as shown in FIG. 4, comprises a J-shaped metal member or shank having a first end formed into a blade 61 and a second end comprising a clamping mechanism, for clamping the plough to the triplex for support which is composed of a semi-circular sector 62 and a complementary semi-circular clasp 63 with flanges for bolting the plough into position. A deflector plate 66 is mounted on the shank 64 proximate to the blade 61. A first leg 68 of the shank of the plough 60, leaving the blade 61, is connected to the second leg 69 of the shank of the plough via a turnbuckle 59.

In operation, the plough 60 is set with the blade 61 just above the liner 16 of the third single face web 9 and below the corrugated medium 12 of the intermediate single face web 8 in the longitudinal path of the board. The plough blade 61 thus lifts the slit strip 48 off the board. The slit strip 48 is then pushed along the upper surfaces of the blade and or shank, or both, until it bears against the deflector plate 66 which is vertical metal plate, set at an angle relative to the travel direction of the board by virtue of an angular relation of the plate relative to the shank or of the shank relative to the path of travel or both. Thus, the slit strip 48 is diverted from the path of travel of the board and is then vacuumed away for shredding and recycling by conventional means (not shown).

If the blades 42, 44 of the slitter mechanism 40 are set to cut only through the first single face web 7, then the blade 61 of the plough 60 is set intermediate the medium 11 of the first single face web 7 and the liner 15 of the second single face web 8. It will be understood, in such case, the score wheels 51 and 52 are set to form the score lines into the second single face web 8 or the fourth liner 17, or both, and that the slit strip will compose only a portion of the first single face web 7. When only the single face web 7 is to be slit, the wiper assembly 34 is engaged with gluing roll 20 to wipe a band of adhesive away from the roll and leave an adhesive free band on medium 11. When the first two single face webs are to be slit, wiper assembly 36 is engaged against gluing roll 21 to wipe a band of adhesive therefrom and leave an adhesive free band on medium 12.

Figure 8:
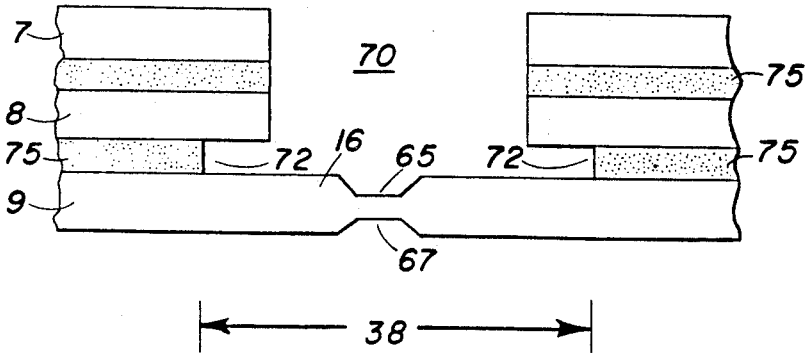
FIG. 8 is an enlarged view of a portion of FIG. 6.
Figure 9:
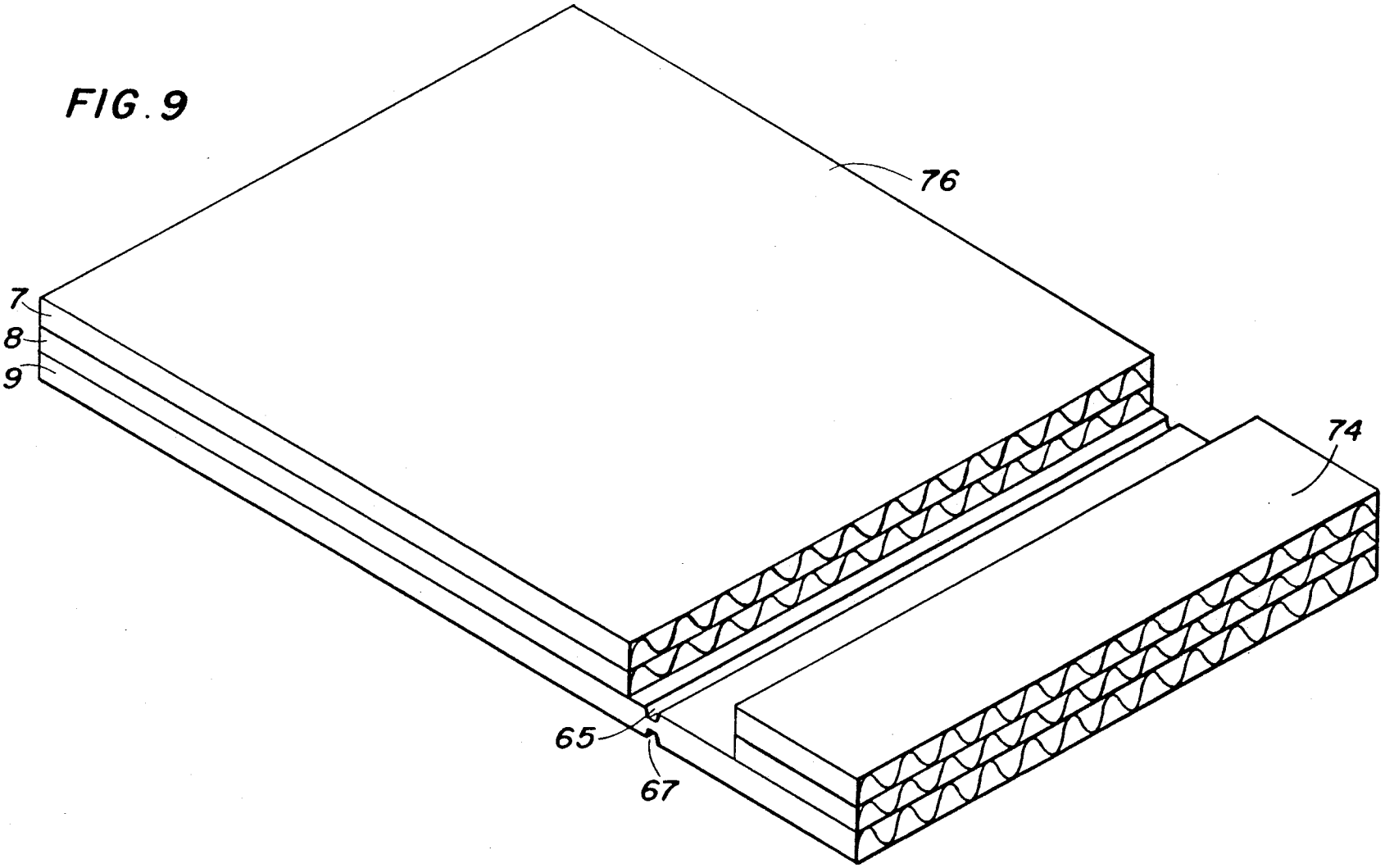
FIG. 9 is a perspective view of FIG. 5.

As shown in FIGS. 5, 6, 8 and 9, the removal of the slit strip 48 leaves a generally rectangular groove 70 in the board, the score lines 65, 67 having been formed in the third single wall sheet 9 and fourth liner 17 underlying the groove 70. As shown in FIG. 8, the bend area in the direction of the corrugations to which adhesive 75 was omitted is wider than the width of the groove 70. Thus, a portion of corrugated mediums of the second single face web 8 is not bonded to the liner 16 of the third single face web 9 by adhesive 75 along an area 72 on either side of the substantially rectangular groove 70. In actuality, however, due to the rigidity of the materials which are adhered to each other, the medium of the single face web 8 is held in a fixed position against the liner of the underlying single wall sheet 9 at the area 72.

The scoring produced by the score wheels allows a portion of the board, defining flap 74, to be bent along a longitudinal line of bend relative to the remaining portion of the board which will typically define a panel 76 of a box to be formed from the board. The groove 70 allows the flap to be bent normal to the panel so that the assembled box may rest flat without rocking yet the force required to bend the board is considerably reduced.

The invention claimed is:

1. An improved device for forming a fold construction in a triple wall corrugated paper board having three corrugated mediums and four flat liners, the corrugated mediums each having corrugations parallel to each other throughout the board, each of the corrugated mediums being adhesively bonded at one side thereof to a different one of the liners to form a single face web with the mediums thereof having ridges at the side of said web opposite the liner, the three single face webs and fourth liner being juxtaposed with the ridges of a first two of the single face webs contiguous with the liner of another of the single face webs and the ridges of the mediums of the other one of said single face webs contiguous with the fourth liner, said device having means for contiguously moving said single face webs and fourth liner through a path of travel with the corrugations transverse to the path of travel, comprising: (a) rotatable gluing rolls for applying adhesive to the ridges; (b) means for preventing the application of adhesive from at least one gluing roll to the ridges of one of the said first two of the single face webs contiguous with the liner of another of the single face webs along a narrow bend area having a width transverse to the corrugations and along a length of the board in the direction of travel; (c) slitting means for cutting a pair of slits through at least one of said first two of the single face webs along the bend area in the direction of travel to form a slit strip between the width of the bend area; (d) a pair of rotatable score rolls mounted in cooperative superimposed relation adapted to form a score between the slit strip, in and along the bend area at least in said other one of said single face webs; and (e) means for removing the slit strip wherein upon the removal of the slit strip a groove is formed between the pair of slits in the bend area, the groove having a width which is less than the width of the narrow bend area where application of the adhesive is prevented.

2. An improved device as set forth in claim 1, wherein said slitting means comprises a pair of rotatable cutting wheels mounted in closed spaced side by side relation.

3. An improved device as set forth in claim 2, wherein said rotatable cutting wheels are mounted adjacent to a liner of the one of said first two single face webs most remote from the fourth liner.

4. An improved device as set forth in claim 2, wherein the rotatable cutting wheels comprise a bevelled cutting surface.

5. An improved device as set forth in claim 1, wherein each of the pair of rotatable score rolls has a profiled surface adapted to form a score along both the said another of the single face webs and fourth liner.

6. An improved device as set forth in claim 1, wherein the score rolls succeed the slit means along the path of travel.

7. An improved device as set forth in claim 1, wherein the removing means include a blade for engaging the ridges of one of the first two of the single face webs contiguous with the liner of said another of the single face webs.

8. An improved device as set forth in claim 7 wherein said removing means further comprises a shank having a first end, said blade being mounted to said shank at said first end, and a deflector plate mounted on the shank for guiding the slit strip away from the board at an angle in respect of the path of travel.

9. An improved device as set forth in claim 7 wherein said blade is set in said path of travel within the bend area between the slits.

10. An improved device as set forth in claim 1 wherein said preventing means comprises means for wiping adhesive from a portion of at least one of the gluing rolls along a circumferential band of the gluing roll.

11. An improved device as set forth in claim 10 wherein said wiping, said slitting means and said rotatable score rolls are successively aligned along the path of travel within the narrow bend area.

12. A plough device for removing a slit strip from a triple wall corrugated paper board comprising:

a blade;

a shank comprising a generally J-shaped member, the shank having a first end and a second end, the first end connected to the blade;

a deflector plate mounted on the shank at an angle in respect of at least one of the blade and the shank;

clamping means mounted on the second end of the shank for mounting the plough device to a support; and a turnbuckle connected between the first end and the second end of the shank.

13. An improved device for forming a fold construction in a triple wall corrugated paper board having three corrugated mediums and four flat liners, the corrugated mediums each having corrugations parallel to each other throughout the board, each of the corrugated mediums being adhesively bonded at one side thereof to a different one of the liners to form a single face web with the mediums thereof having ridges at the side of said web opposite the liner, the three single face webs and fourth liner being juxtaposed with the ridges of a first two of the single face webs contiguous with the liner of another of the single face webs and the ridges of the mediums of the other one of said single face webs contiguous with the fourth liner, said device having means for contiguously moving said single face webs and fourth liner through a path of travel with the corrugations transverse to the path of travel, comprising: (a) rotatable gluing rolls for applying adhesive to the ridges; (b) means for preventing the application of adhesive from at least one gluing roll to the ridges of one of the said first two of the single face webs contiguous with the liner of another of the single face webs along a narrow bend area transverse to the corrugations and along a length of the board in the direction of travel; (c) slitting means for cutting a pair of slits through at least one of said first two of the single face webs along the bend area in the direction of travel to form a slit strip; (d) a pair of rotatable score rolls mounted in cooperative superimposed relation adapted to form a score along the bend area at least in the said other one of said single face webs; and (e) means for removing the slit strip comprising a blade for engagement between the pair of slits and under at least one of said first two of the single face webs.

14. An improved device as set forth in claim 13 wherein said removing means further comprises a shank having a first end, said blade being mounted to said shank at said first end, and a deflector plate mounted on the shank for guiding the slit strip away from the board at an angle in respect of the path of travel.

15. An improved device as set forth in claim 13 wherein said blade is set in said path of travel within the bend area between the slits.

* * * * *